US008152237B2

(12) United States Patent
Saul

(10) Patent No.: US 8,152,237 B2
(45) Date of Patent: Apr. 10, 2012

(54) STACKING CHAIR

(75) Inventor: Gregory M. Saul, Charlotte, NC (US)

(73) Assignee: Michigan Tube Swagers & Fabricators, Inc., Temperance, MI (US)

( * ) Notice: Subject to any disclaimer, the term of this patent is extended or adjusted under 35 U.S.C. 154(b) by 140 days.

(21) Appl. No.: 12/777,703

(22) Filed: May 11, 2010

(65) Prior Publication Data

US 2010/0289306 A1 Nov. 18, 2010

Related U.S. Application Data

(60) Provisional application No. 61/177,781, filed on May 13, 2009.

(51) Int. Cl.
*A47C 3/04* (2006.01)

(52) U.S. Cl. ..... 297/239; 297/446.1

(58) Field of Classification Search ..... 297/239, 297/446.1

See application file for complete search history.

(56) References Cited

U.S. PATENT DOCUMENTS

| | | | | |
|---|---|---|---|---|
| 2,997,339 | A | 8/1961 | Wilson | |
| 3,102,733 | A | 9/1963 | Burnett | |
| 5,524,963 | A | 6/1996 | Barile | |
| 5,762,396 | A | 6/1998 | Barile | |
| 5,997,084 | A | 12/1999 | Barile, Jr. et al. | |
| 6,174,029 | B1 * | 1/2001 | Swy | 297/239 X |
| 6,666,518 | B2 | 12/2003 | Bruschi et al. | |
| 6,715,838 | B1 * | 4/2004 | Pflaster et al. | 297/239 X |
| 6,820,934 | B2 * | 11/2004 | Ware et al. | 297/239 X |
| 6,860,556 | B2 | 3/2005 | Barile, Sr. et al. | |
| D603,616 | S | 11/2009 | Kubryk | |
| 2009/0072599 | A1 * | 3/2009 | Xu | 297/239 |

* cited by examiner

*Primary Examiner* — Rodney B White
(74) *Attorney, Agent, or Firm* — Gifford, Krass, Sprinkle, Anderson & Citkowski, P.C.; Douglas L. Wathen

(57) ABSTRACT

A chair is designed to stack generally vertically with a number of like chairs. A chair frame has a pair of front legs and a pair of rear legs and a generally horizontal seat frame element that is supported by the front and rear legs. A generally horizontal stack frame element is interconnected with the front and rear legs of the chair frame and is spaced below the seat ring. A seat is supported by the chair frame. When the chair is stacked on a like chair, the stack frame element of the upper chair is disposed on and supported by the seat frame element of the lower chair.

23 Claims, 5 Drawing Sheets

STACKING CHAIR

CROSS REFERENCE TO RELATED APPLICATION

This utility patent application claims priority from U.S. provisional patent application Ser. No. 61/177,781, filed May 13, 2009, the entire content of which is incorporated herein by reference.

FIELD OF THE INVENTION

The present invention relates generally to chairs and, more specifically, to chairs that can be generally vertically stacked such that the frame of an upper chair is supported by the frame of a lower chair in the stack.

BACKGROUND OF THE INVENTION

Chairs that are used in conference rooms and other applications are often designed such that multiple chairs may be stacked in a generally vertical stack for storage when not in use. One typical type of stacking chair has a frame with leg members that are each generally shaped like an inverted U and define a front and a rear leg on one side of the chair. The chairs are stacked such that these leg members stack atop each other to foul) a stable stack of chairs. A disadvantage with this design is that it imposes certain limitations on the design and look of the chair. In another type of stacking chair, the seat cushion of a lower chair in a stack supports an upper chair in the stack. That is, the seat cushions are responsible for forming the stack. This approach allows additional design freedom, but has several limitations. First, because the seat cushions are typically formed of a resilient material, the stability of the stack of chairs is compromised. Second, stacking the chairs may cause wear on the seat cushions, since the upper face of the seat cushion supports a chair stacked thereon.

SUMMARY OF THE INVENTION

The present invention provides a chair with an alternative frame design that allows frame-on-frame stacking but does not require the use of inverted U-shaped leg members. Instead, some embodiments of the present invention include a seat ring that is supported by front and rear legs and a stack ring that is spaced below the seat ring and is interconnected with the front and rear legs. When the chairs are stacked, the stack ring of an upper chair is supported by the seat ring of a lower chair.

In some embodiments of the present invention, a chair has a chair frame with a pair of front legs and a pair of rear legs. The frame includes a generally horizontal seat frame element supported by the front and rear legs. The seat frame element has a pair of side portions. A generally horizontal stack frame element is interconnected with the front and rear legs of the chair frame and is spaced below the seat frame element. The stack frame element includes a pair of side portions. A seat is supported by the chair frame. When the chair is stacked on a like chair, the stack frame element of the upper chair is disposed on and supported by the seat frame element of the lower chair. The rear legs of the chair are each formed of tubing having a generally rectangular cross section so as to define four tube faces. The faces include an inward face and an opposed outward face. The rear legs are angled outwardly such that the inward and outward faces are disposed at a non-zero angle to an axis bisecting the chair front to rear. The rear legs are disposed such that when the chair is stacked on a like chair, the inward faces of the rear legs of the upper chair are disposed adjacent the outward faces of the rear legs of the lower chair.

Each side portion of the seat frame element may extend between one of the front legs and one of the rear legs. Further, the seat frame element may be a seat ring that further includes a rear portion extending between the side portions. In some versions, a unitary front frame member defines the front legs and the seat ring. The seat may have a pair of opposed side edges and a rear edge, with the side and rear edges of the seat being disposed inboard of the seat ring.

Each of the side portions of the stacked frame element may extend between one of the front legs and one of the rear legs. Further, the stack frame element may be a stack ring that further has a rear portion extending between the side portions.

In some versions, the seat frame element is a seat ring with a rear portion extending between the side portions and the stack frame element is a stack ring with a rear portion extending between the side portions. The rear portions of the seat ring and the stack ring may be arc shaped such that both the seat ring and the stack ring are generally U-shaped. In some embodiments, the rear portion of the stack ring is offset rearwardly with respect to the rear portion of the seat ring. In some versions, the seat frame element and the stack frame element are generally parallel to one another. The rear legs may be formed such that when the chair is stacked on a like chair, the rear legs of the upper chair are disposed generally forwardly of the rear legs of the chair. In some embodiments, the lion-zero angle between the inward or outward face of the tube forming each rear leg and the axis bisecting the chair may be in the range of 40-50 degrees.

In a further embodiment, the chair has a chair frame with a pair of front legs and a pair of rear legs. The frame includes a generally horizontal seat ring supported by the front and rear legs. The seat ring has a pair of side portions and rear portion extending between the side portions. A generally horizontal stack ring is interconnected with the front and rear legs of the chair frame and spaced below the seat ring. A seat is supported by the chair frame. When the chair is stacked on a like chair, the stack ring of the upper chair is disposed on and supported by the seat ring of the lower chair.

The stack ring may have a pair of side portions and a rear portion extending between the side portions. The rear portions of the seat ring and the stack ring may both be arc shaped such that the seat ring and stack ring are both generally U-shaped. In some versions, the rear portion of the stack ring is offset rearwardly with respect to the rear portion of the seat ring. In some versions, the seat ring and the stack ring are generally parallel to one another. The rear legs of the chair may be formed such that when the chair is stacked on a like chair, the rear legs of the upper chair are disposed generally forwardly of the rear legs of the lower chair.

In some versions, the rear legs are each formed of tubing with a generally rectangular cross-section so as to define four tube faces. A fore-aft axis of the chair is defined extending between the forward and rearward edges of the chair and bisecting the chair into generally minor image halves. The rear legs are angled outwardly such that the faces are rotated about a vertical axis with respect to the fore-aft axis. The rear legs may be said to have an inner face that is directed generally towards the fore-aft axis and an outer face that is directed generally away from the fore-aft axis. An angle is defined between the inner face and the fore-aft axis. In some versions, this angle is in the range of 40-50 degrees.

In further versions, the rear legs are formed of tubing having a generally rectangular cross-section so as to define four tube faces. The faces include an inward face and an opposed outward face. The inward and outward faces are disposed at a non-zero angle to an axis bisecting the chair front-to-rear and the rear legs are disposed such that when the chair is stacked on a like chair, the inward faces of the rear legs of the upper chair are disposed adjacent the outward faces of the rear legs of the lower chair.

In some versions, a unitary front frame member defines the front legs and the seat ring.

In a further embodiment, a chair has a chair frame with a pair of front legs and a pair of rear legs. The frame includes a generally horizontal seat ring supported by the front and rear legs. The seat ring has a pair of side portions and a rear portion extending between the side portions. A generally horizontal stack ring is interconnected with the front and rear legs of the chair frame and spaced below the seat ring. The stack ring has a pair of side portions and a rear portion extending between the side portions. A seat is supported by the chair frame. The seat has a pair of opposed side edges and a rear edge. The side and rear edges of the seat are disposed inboard of the seat ring. When the chair is stacked on a like chair, the stack ring of the upper chair is disposed on and supported by the seat ring of the lower chair. The rear legs are each formed of tubing having a generally rectangular cross-section so as to define four tube faces. The faces include an inward face and an opposed outward face. The rear legs are angled outwardly such that the inward and outward faces that are disposed at a non-zero angle to an axis bisecting the chair front-to-rear. The rear legs are disposed such that when the chair is stacked on a like chair, the inward faces of the rear legs of the upper chair are disposed adjacent the outward faces of the rear legs of the lower chair.

DETAILED DESCRIPTION OF THE PREFERRED EMBODIMENTS

The present invention provides a chair that can be stacked frame-on-frame with a plurality of like chairs. Each chair has a chair frame with a pair of front and rear legs and a generally horizontal seat frame element that is supported by the front and rear legs. In the illustrated embodiment, the seat frame element is referred to as a seat ring, having a pair of side portions that each extend between one of the front and one of the rear legs and a rear portion that extends between the side portions. A generally horizontal stack frame element is interconnected with the front and rear legs of the chair frame and is spaced below the seat frame element. A seat is also supported by the chair frame. When the chair is stacked on a like chair, the stack frame element of the upper chair is disposed on and supported by the seat frame element of the lower chair.

Figure 1:
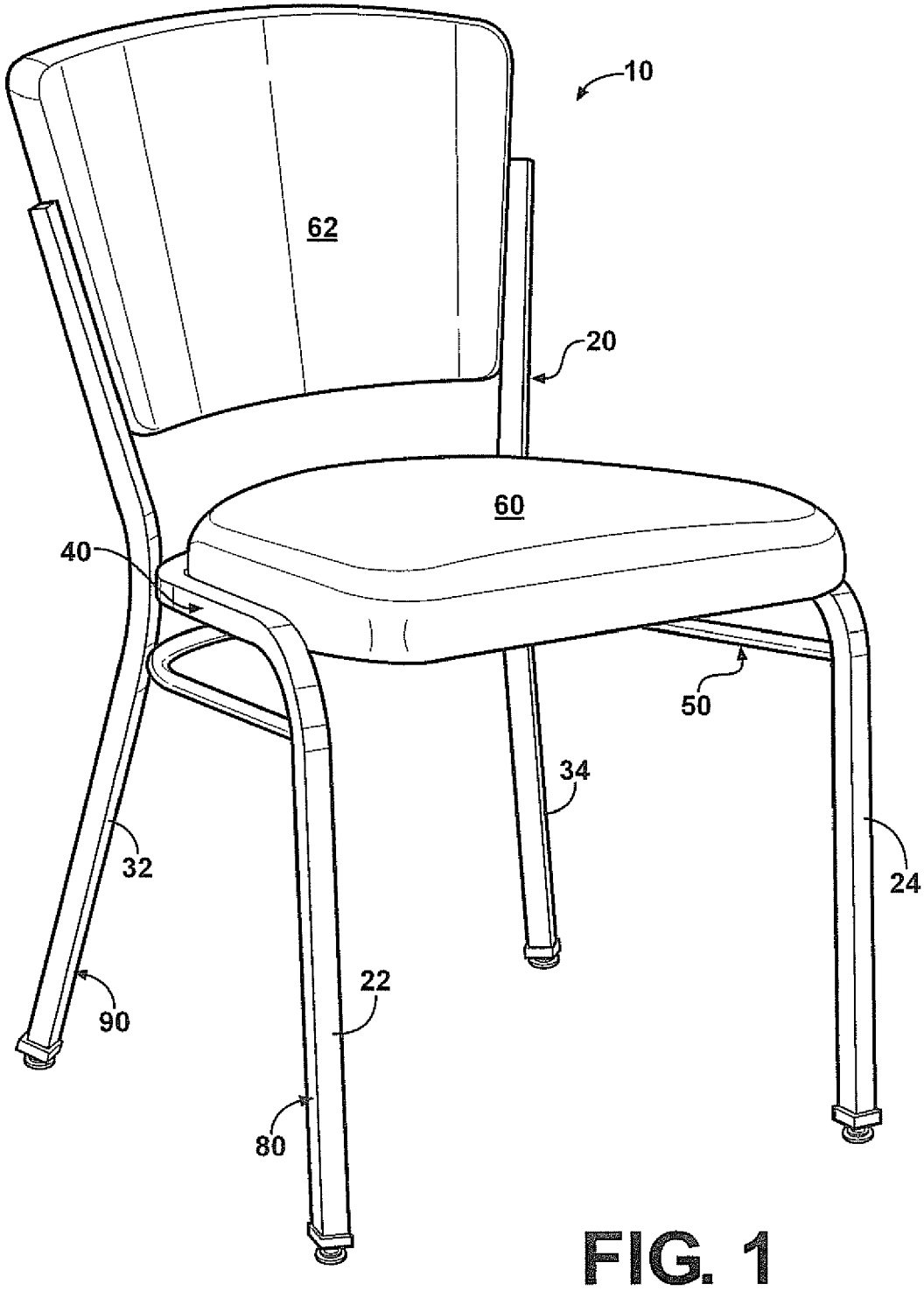
FIG. 1 is a perspective view of an embodiment of a stacking chair according to the present invention.

Referring to FIG. 1, a chair according to the present invention is generally shown at 10. The chair 10 includes a chair frame 20 having a pair of front legs 22 and 24 and a pair of rear legs 32 and 34. The frame 20 also includes a seat frame element, in the form of seat ring 40, that is generally horizontal and is supported by the legs 22, 24, 32, 34. The seat frame element may take other forms than the continuous seat ring illustrated, including being made as two or more separate pieces that may or may not be interconnected with one another. Also, the term "ring" as used herein is not intended to mean a closed circle. Instead, the seat "ring" maybe generally U-shaped, as illustrated. As will be understood by those of skill in the art, the generally horizontal seat ring may be tilted slightly with respect to absolute horizontal as is typical with chairs.

The chair 10 also includes a stack frame element that is interconnected with the front and rear legs and spaced below the seat frame element or seat ring 40. The stack frame element may take a variety of forms, including a form similar to the seat ring 40. In the illustrated embodiment, the stack frame element takes the form of a stack ring that is generally U-shaped, similar to the seat ring. The stack ring 50 is also generally horizontal and may be parallel to the seat ring 40. The illustrated chair 10 also includes a seat 60, which may be a padded seat cushion, and a seat back 62, which may take a variety of forms including a rigid wood or metal back or a back cushion.

Figure 3:
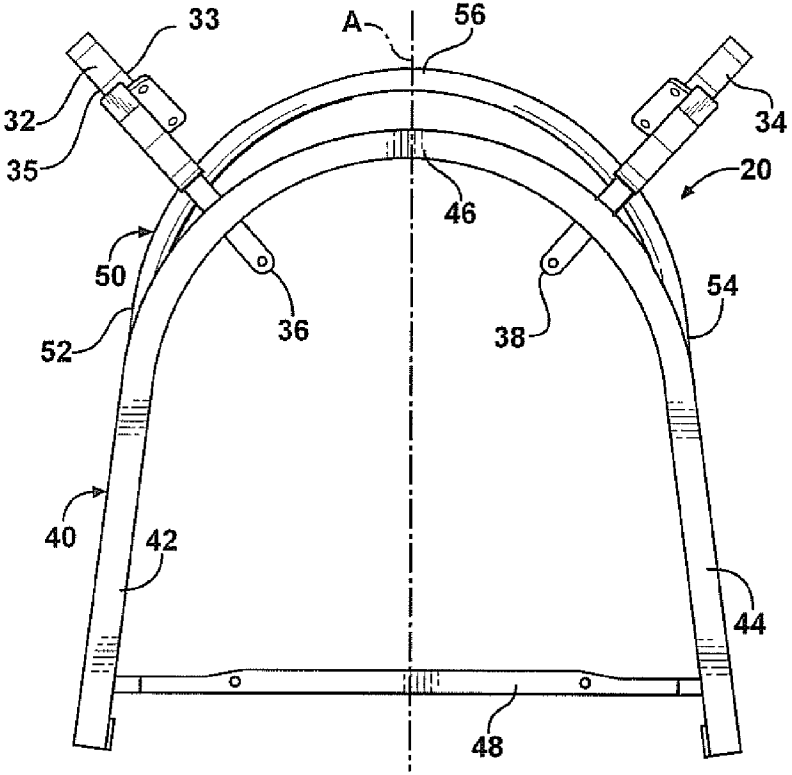
FIG. 3 is a top view of the chair frame of FIG. 2.
Figure 2:
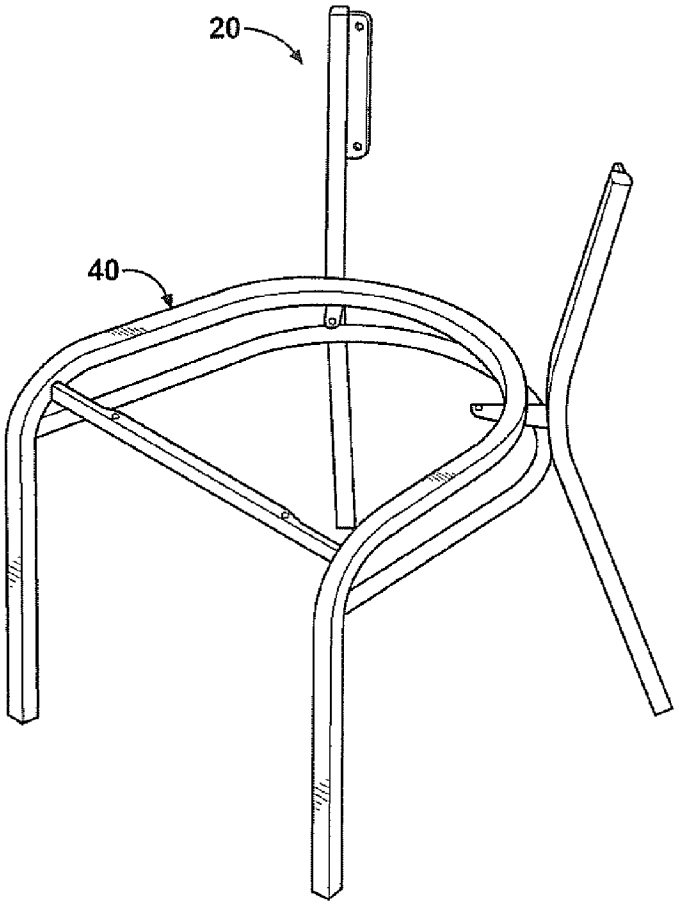
FIG. 2 is a view of the chair frame for the chair of FIG. 1, with the seat cushion and back cushion removed.

Referring now to FIGS. 2 and 3, the chair frame 20 is shown with the seat 60 and seat back 62 removed. The seat ring 40 may be said to have a pair of side portions 42 and 44 that each extend between one of the front legs and one of the rear legs. The side portions 42 and 44 may be integrally formed with one or more of the legs, may be directly interconnected with one or both legs, or may be indirectly interconnected with one or both legs such as by a bracket. In the illustrated embodiment, the side portions 42 and 44 are each integrally formed with the corresponding front leg 22 and 24, respectively. A rear portion 46 extends between the side portions 42 and 44. In the illustrated embodiment, the rear portion 46 is generally arc shaped thereby giving the seat ring a generally U-shaped appearance. In the illustrated embodiment, the side portions 42 and 44 are interconnected with the rear legs 32 and 34 indirectly, since they are interconnected with the arc shaped rear portion 46, which in turn is interconnected with the rear legs 32 and 34 by support brackets 36 and 38. Support brackets 36 and 38 extend forwardly from the rear legs 32 and 34, respectively, underneath the seat ring 40 and beyond the seat ring so as to provide support for the seat 60. A seat support bar 48 also extends side to side between the side portions 42 and 44 and supports the seat 60. The seat 60 may alternatively be supported in other ways. As shown in FIG. 1, the seat 60 is disposed entirely inboard of the seat ring 40 thereby leaving the upper surface of the seat ring 40 clear for use in stacking. However, the seat 60 is immediately adjacent the seat ring.

In the illustrated embodiment, the stack ring 50 generally mirrors the shape of the seat ring 40 but is offset rearwardly, as best shown in the top view of FIG. 3. It also may be said to have a pair of side portions 52 and 54 and a rear portion 56 that extends between the side portions 52 and 54. In the illustrated embodiment, the rear portion 56 is arc shaped, thereby giving the overall stack ring a generally U-shaped appearance. The front ends of the side portions 52 and 54 are interconnected with the front legs 22 and 24, respectively, and the rear portion 56 is interconnected with the rear legs 32 and 34. As shown, in the illustrated embodiment, the stack ring 50 is spaced below the seat ring 40 and is generally parallel thereto. In some embodiments, both the seat ring and the stack ring are angled with respect to horizontal by approximately 4 degrees, sloping downwardly from the front edge to the rear edge.

Alternatively, the seat ring and stack ring may not be parallel to one another, and may be at a slight angle to one another.

Referring again to FIG. 3, the illustrated embodiment of the chair 10 has rear legs 32 and 34 that are angled such that they extend both rearwardly and outwardly with respect to the chair as they extend downwardly. The chair may be said to have a fore-aft axis A that generally bisects the chair into two mirror image halves. As shown, the legs 32 and 34 are angled outwardly with respect to this axis A. In the illustrated embodiment, the legs 32 and 34 are each formed from tubing having a generally rectangular cross section. Such a tube may be said to have four faces that are each perpendicular to the adjacent faces. Referring to leg 32, it may be said to have an inner face 33 and an opposed outer face 35, with the inner face generally directed towards the axis A and the outer face 35 generally directed away from the axis. As shown, these faces are each angled with respect to the axis A at a substantial non-zero angle. In some embodiments, the angle between the inner face 33 and the axis A is in the range of 40 to 50 degrees.

Figure 4:
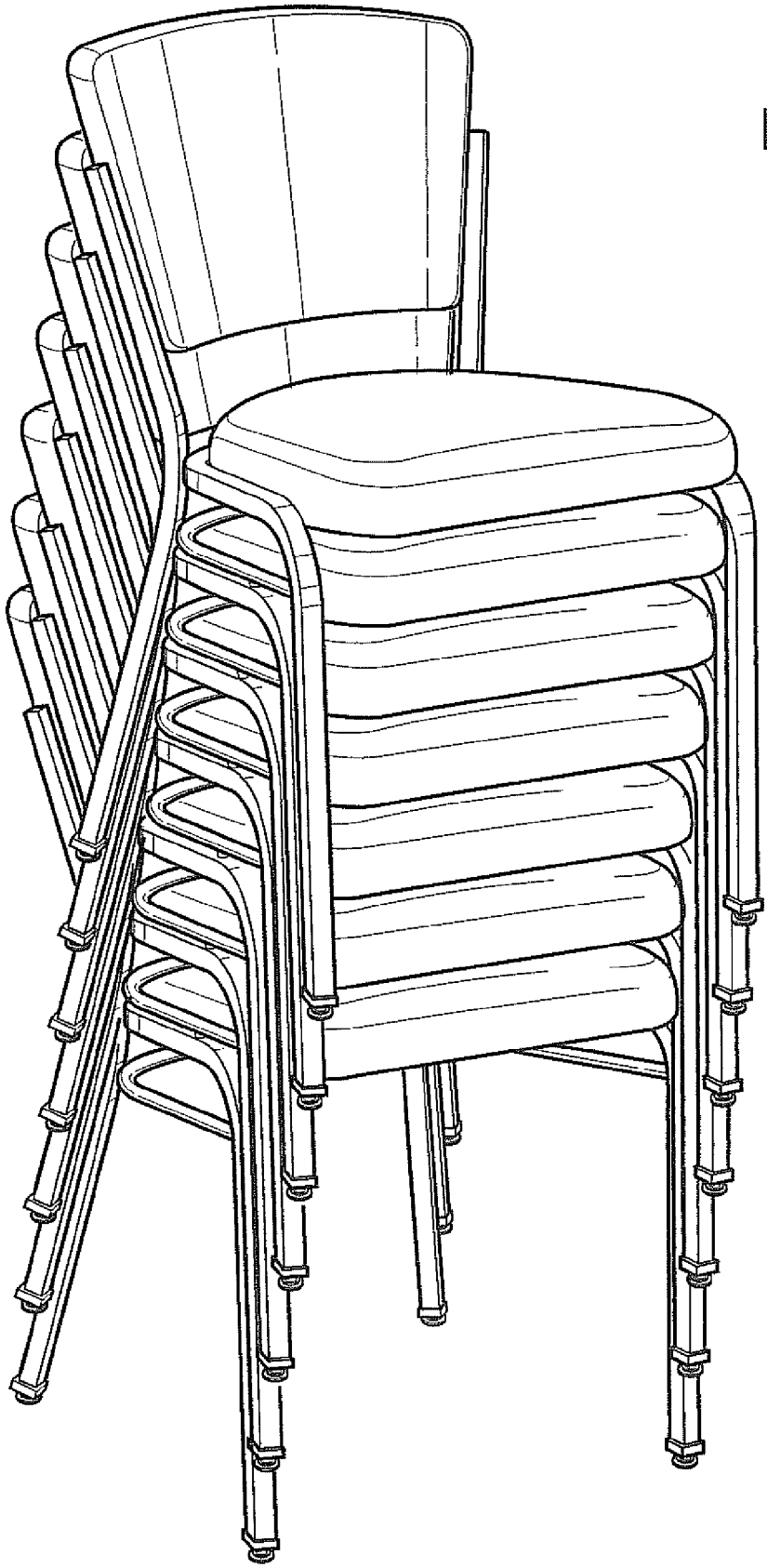
FIG. 4 is a perspective view of a plurality of chairs according to the present invention stacked in a generally vertical stack.

FIG. 4 shows a perspective view of a plurality of chairs as shown in FIG. 1 stacked in a generally vertical stack with the stack ring of each upper chair resting on and being supported by the seat ring of the next lower chair. As also shown in FIG. 4, the rear legs of each upper chair are disposed generally forwardly of the rear leg of the next lower chair when stacked. Also, the inner face of the rear leg of an upper chair is adjacent the outer face of the rear leg of the next adjacent lower chair. Likewise, in the illustrated embodiment, the front legs of each upper chair are disposed generally forward of the front legs of the next lower chair in the stack. In the illustrated embodiment, the front legs do not touch one another to stabilize the stack. However, the rear legs align with each other so as to help stabilize the stack of chairs. It should be noted that, as used herein with respect to the positioning of the rear legs, the term "forwardly" does not require that the entirety of the leg that is positioned "forwardly" of another leg is forward, but that the forward edge of one leg is forward of the other. In other words, the legs may overlap, with the one extending furthest forward being the leg that is positioned forwardly of the other.

Figure 5:
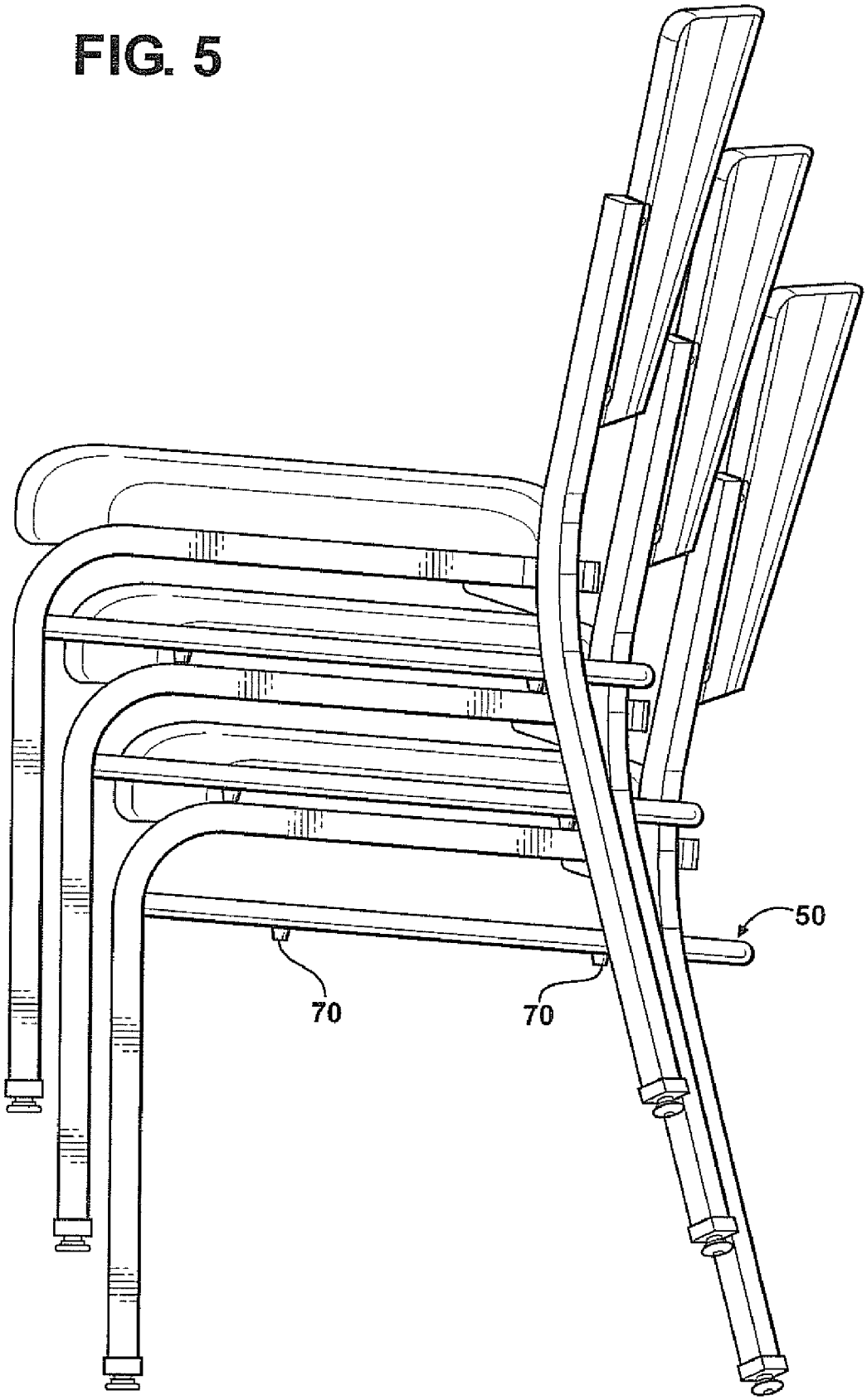
FIG. 5 is a side view of three chairs according to the present invention stacked in a generally vertical stack.
Figure 6:
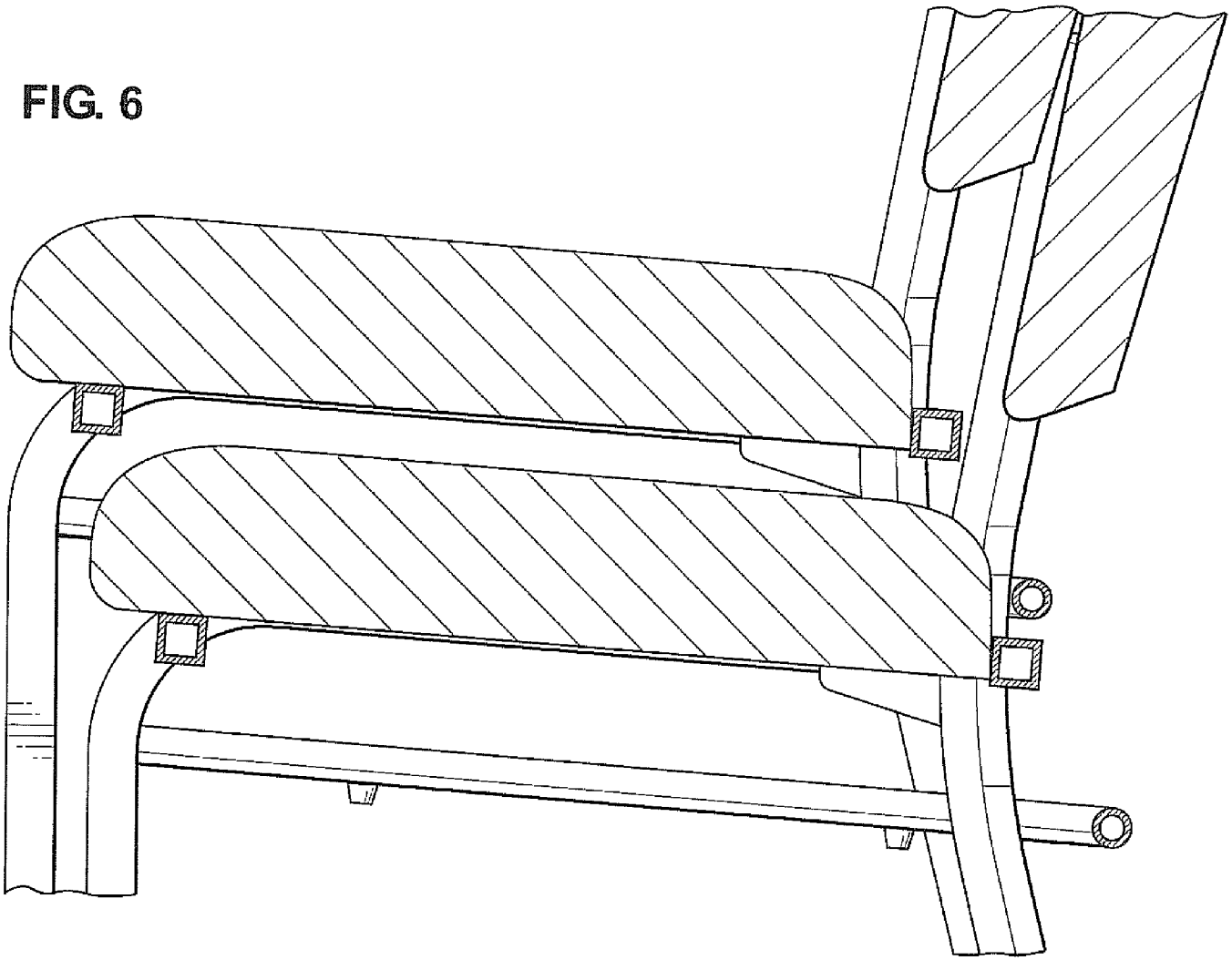
FIG. 6 is a cross-sectional side view of two chairs according to the present invention stacked one on top of the other.

Referring now to FIGS. 5 and 6, more details of the stacking of the chairs may be seen. As shown in FIG. 5, the chairs may have bumpers 70 disposed on the underside of the stack ring 50 such that when a chair is stacked on top of a like chair, the bumpers engage the seat ring of the lower chair. This helps protect the finish of the seat ring and stack ring. In some embodiments, a bumper is provided generally towards the forward end of each side portion and another bumper is provided near the rear leg. Alternatively or additionally, a bumper may be provided midway along the rear portion of the stack ring. The bumpers may be considered part of the stack ring.

As will be clear to those of skill in the art, the chair design illustrated herein may be altered in various ways without departing from the scope of the present invention. For example, the frame may be formed differently than illustrated while still providing the seat frame element and stack frame element features. In the illustrated embodiment, the frame is formed using a unitary front element that forms both the front legs and the entirety of the seat ring. This frame member is labeled 80 in FIG. 1. Starting at the floor, the member 80 extends upwardly to form front leg 22, bends rearwardly to form the side portion 42 of the seat ring 40, curves around to form the rear portion 46 and extends forwardly to form the other side portion 44. It then bends downwardly and extends downwardly to form the other front leg 24. Additional rear frame members form the rear legs. One frame member is labeled 90 in FIG. 1 and extends upwardly from the floor to interconnect with both the stack ring 50 and seat ring 40 and then bends outwardly so as to provide support for the seat back 62. A similar frame member forms the other leg 34 and additional support for the back 62.

As another alternative, the seat ring and stack ring may both be shaped differently than shown, such as being more squared off. Further, the seat ring and stack ring may have different shapes than each other. As will be clear to those of skill in the art, the frame may be formed in other ways. It is the following claims, including all equivalents, which define the scope of the present invention.

The invention claimed is:

1. A chair configured to be generally vertically stacked with a number of chairs identical in structure to the chair, the chair comprising:

a chair frame having a pair of front legs and a pair of rear legs, the frame including a generally horizontal seat frame element supported by the front and rear legs, the seat frame element having a pair of side portions;

a generally horizontal stack frame element interconnected with the front and rear legs of the chair frame and spaced below the seat frame element, the stack frame element including a pair of side portions;

a seat supported by the chair frame;

wherein when the chair is stacked on a chair identical in structure to the chair, the stack frame element of the upper chair is disposed on and supported by the seat frame element of the lower chair; and the rear legs each being formed of tubing having a generally rectangular cross section so as to define four tube faces, the faces including an inward face and an opposed outward face, the rear legs being angled outwardly such that the inward and outward faces are disposed at a non-zero angle to a fore-aft axis bisecting the chair from front to rear, the inward faces of the rear legs being directed toward the fore-aft axis, the rear legs being disposed such that when the chair is stacked on a chair identical in structure to the chair, the inward faces of the rear legs of the upper chair are disposed adjacent the outward faces of the rear legs of the lower chair.

2. The chair according to claim 1, wherein each side portion of the seat frame element extends between one of the front legs and one of the rear legs.

3. The chair according to claim 2, wherein the seat frame element is a seat ring further having a rear portion extending between the side portions.

4. The chair according to claim 3, wherein a unitary front frame member defines the front legs and the seat ring.

5. The chair according to claim 3, wherein the seat has a pair of opposed side edges and a rear edge, the side and rear edges of the seat being disposed inboard of the seat ring.

6. The chair according to claim 1, wherein each side portion of the stack frame element extends between one of the front legs and one of the rear legs.

7. The chair according to claim 6, wherein the stack frame element is a stack ring further having a rear portion extending between the side portions.

8. The chair according to claim 1, wherein:

the seat frame element is a seat ring further having a rear portion extending between the side portions; and the stack frame element is a stack ring further having a rear portion extending between the side portions.

9. The chair according to claim 8, wherein the rear portions of the seat ring and the stack ring are both arc shaped such that the seat ring and stack ring are both generally U-shaped.

10. The chair according to claim 8, wherein the rear portion of the stack ring is offset rearwardly with respect to the rear portion of the seat ring.

11. The chair according to claim 1, wherein the seat frame element and the stack frame element are generally parallel to each other.

12. The chair according to claim 1, wherein the rear legs are formed such that when the chair is stacked on a chair identical in structure to the chair, the rear legs of the upper chair are disposed generally forwardly of the rear legs of the lower chair.

13. The chair according to claim 1, wherein the non-zero angle is in the range of 40 to 50 degrees.

14. A chair configured to be generally vertically stacked with a number of chairs identical in structure to the chair, the chair comprising:

a chair frame having a pair of front legs and a pair of rear legs, the frame including a generally horizontal seat ring supported by the front and rear legs, the seat ring having a pair of side portions and a rear portion extending between the side portions;

a generally horizontal stack ring interconnected with the front and rear legs of the chair frame and spaced below the seat ring, the stack ring having a pair of side portions and a rear portion extending between the side portions; and a seat supported by the chair frame;

wherein when the chair is stacked on a chair identical in structure to the chair, the stack ring of the upper chair is disposed on and supported by the seat ring of the lower chair.

15. The chair according to claim 14, wherein the rear portions of the seat ring and the stack ring are both arc shaped such that the seat ring and stack ring are both generally U-shaped.

16. The chair according to claim 14, wherein the rear portion of the stack ring is offset rearwardly with respect to the rear portion of the seat ring.

17. The chair according to claim 14, wherein the seat ring and the stack ring are generally parallel to each other.

18. A chair configured to be generally vertically stacked with a number of chairs identical in structure to the chair, the chair comprising:

a chair frame having a pair of front legs and a pair of rear legs, the frame including a generally horizontal seat ring supported by the front and rear legs, the seat ring having a pair of side portions and a rear portion extending between the side portions;

a generally horizontal stack ring interconnected with the front and rear legs of the chair frame and spaced below the seat ring; and a seat supported by the chair frame;

wherein when the chair is stacked on a chair identical in structure to the chair, the stack ring of the upper chair is disposed on and supported by the seat ring of the lower chair; and wherein the rear legs are formed such that when the chair is stacked on a chair identical in structure to the chair, the rear legs of the upper chair are disposed generally forwardly of the rear legs of the lower chair.

19. The chair according to claim 18, wherein the rear legs are each formed of tubing having a generally rectangular cross section so as to define four tube faces, a fore-aft axis of the chair being defined extending between the forward and rearward edges of the chair and bisecting the chair into generally mirror image halves, the rear legs being angled outwardly such that the faces are rotated about a vertical axis with respect to the fore-aft axis.

20. The chair according to claim 19, wherein the rear legs each have an inner face directed generally towards the fore-aft axis and an outer face directed generally away from the fore-aft axis, an angle being defined between the inner face and the fore-aft axis, the angle being in the range of 40 to 50 degrees.

21. The chair according to claim 14, wherein the rear legs are each formed of tubing having a generally rectangular cross section so as to define four tube faces, the faces including an inward face and an opposed outward face, the inward and outward faces being disposed at a non-zero angle to an axis bisecting the chair front to rear and the rear legs are disposed such that when the chair is stacked on a chair identical in structure to the chair, the inward faces of the rear legs of the upper chair are disposed adjacent the outward faces of the rear legs of the lower chair.

22. A chair configured to be generally vertically stacked with a number of chairs identical in structure to the chair, the chair comprising:

a chair frame having a pair of front legs and a pair of rear legs, the frame including a generally horizontal seat ring supported by the front and rear legs, the seat ring having a pair of side portions and a rear portion extending between the side portions, a unitary front frame member defining the front legs and the seat ring;

a generally horizontal stack ring interconnected with the front and rear legs of the chair frame and spaced below the seat ring; and a seat supported by the chair frame;

wherein when the chair is stacked on a chair identical in structure to the chair, the stack ring of the upper chair is disposed on and supported by the seat ring of the lower chair.

23. A chair configured to be generally vertically stacked with a number of chairs identical in structure to the chair, the chair comprising:

a chair frame having a pair of front legs and a pair of rear legs, the frame including a generally horizontal seat ring supported by the front and rear legs, the seat ring having a pair of side portions and a rear portion extending between the side portions;

a generally horizontal stack ring interconnected with the front and rear legs of the chair frame and spaced below the seat ring, the stack ring having a pair of side portions and a rear portion extending between the side portions; and a seat supported by the chair frame, the seat having a pair of opposed side edges and a rear edge, the side and rear edges of the seat being disposed inboard of the seat ring;

wherein when the chair is stacked on a chair identical in structure to the chair, the stack ring of the upper chair is disposed on and supported by the seat ring of the lower chair; and the rear legs each being formed of tubing having a generally rectangular cross section so as to define four tube faces, the faces including an inward face and an opposed outward face, the rear legs being angled outwardly such that the inward and outward faces are disposed at a non-zero angle to an axis bisecting the chair front to rear, the rear legs being disposed such that when the chair is stacked on a chair identical in structure to the chair, the inward faces of the rear legs of the upper chair are disposed adjacent the outward faces of the rear legs of the lower chair.

* * * * *

UNITED STATES PATENT AND TRADEMARK OFFICE

CERTIFICATE OF CORRECTION

PATENT NO. : 8,152,237 B2
APPLICATION NO. : 12/777703
DATED : April 10, 2012
INVENTOR(S) : Gregory M. Saul It is certified that error appears in the above-identified patent and that said Letters Patent is hereby corrected as shown below:

Col. 1, line 27: replace “foul)” with -- form --
Col. 2, line 29: replace “lion-” with -- non- --
Col. 2, line 57: replace “minor” with -- mirror --
Col. 5, line 16: replace “axis.” with -- axis A. --

Signed and Sealed this
Twenty-sixth Day of June, 2012

David J. Kappos

David J. Kappos
*Director of the United States Patent and Trademark Office*